US007845467B2

(12) United States Patent
Petzl et al.

(10) Patent No.: US 7,845,467 B2
(45) Date of Patent: Dec. 7, 2010

(54) MULTIFUNCTIONAL BELAYING DEVICE FOR A ROPE

(75) Inventors: Paul Petzl, Barraux (FR); Christian Broquerie, Fontaine (FR)

(73) Assignee: Zedel, Crolles (FR)

( * ) Notice: Subject to any disclaimer, the term of this patent is extended or adjusted under 35 U.S.C. 154(b) by 918 days.

(21) Appl. No.: 11/714,738

(22) Filed: Mar. 7, 2007

(65) Prior Publication Data

US 2007/0215411 A1 Sep. 20, 2007

(30) Foreign Application Priority Data

Mar. 15, 2006 (FR) ..... 06 02289

(51) Int. Cl.
*A62B 1/08* (2006.01)

(52) U.S. Cl. ..... 182/5; 182/71; 182/72; 182/193; 188/65.1; 254/391

(58) Field of Classification Search ..... 182/5, 182/191–193, 71, 72; 254/4 B, 389, 391, 254/393; 188/65.1–5.5
See application file for complete search history.

(56) References Cited

U.S. PATENT DOCUMENTS 2,931,466 A * 4/1960 Allenbaugh ..... 188/188
4,541,149 A 9/1985 Jensen
5,076,400 A 12/1991 Petzl et al.
5,577,576 A 11/1996 Petzl et al.
5,845,894 A * 12/1998 Petzl et al. ..... 254/391
6,029,777 A 2/2000 Rogelja

FOREIGN PATENT DOCUMENTS

EP 0 117 466 A1 9/1984
EP 0 398 819 A1 11/1990
FR 2 721 522 12/1995
FR 2 721 523 12/1995

* cited by examiner

*Primary Examiner*—Katherine W Mitchell
*Assistant Examiner*—Daniel Cahn
(74) *Attorney, Agent, or Firm*—Oliff & Berridge, PLC

(57) ABSTRACT

A belaying device for a rope comprises a cam able to rotate between a securing position corresponding to securing the rope by jamming effect against the stud and a separated position allowing the rope to run freely in the gap between the cam and the stud. The cam is associated with a triggering ratchet able to occupy either a locked position blocking the cam in the separated position or an unlocked position following a deliberate control action releasing said cam.

11 Claims, 15 Drawing Sheets

MULTIFUNCTIONAL BELAYING DEVICE FOR A ROPE

BACKGROUND OF THE INVENTION

The invention relates to a belaying device for a rope, comprising:

a support plate equipped with a fixed stud, a cam mounted with limited rotation on the support plate around a first spindle-pin and having a peripheral sector around which the rope is wound, said cam being movable between a securing position corresponding to the rope being blocked by a jamming effect against the stud and a separated position enabling the rope to run freely in the gap between the cam and the stud.

STATE OF THE ART

The document EP-A-398819 describes a belaying device that is self-locking in the event of a sharp tension occurring. It comprises a cam mounted on a pivoting support plate equipped with a handle for manual release of the rope. A return spring of the support plate biases the cam to the open position allowing the rope to slide freely. The cam is provided with two braking surfaces, and the threshold for switching from the first locked position to the second locked position depends on the hardness or the loading of the return spring.

The document FR-A-2721523 relates to a self-locking belayer and descender having a pivoting cam subjected to the action of a return spring that biases it to the released position. The cam can be actuated manually between the locked and released positions depending on the angular position of an operating handle of the mechanism.

In another known belaying device, the cam is kept in the open position by a securing device with a telescopic ball constituting a holding hard point which is cleared according to the force exerted by the rope on the cam.

In these known devices, movement of the cam to the locked position of the rope does however remain dependent on the diameter of the rope, on the running speed and on the friction of the rope on the cam.

The document EP 117 466 relates to a jamming cleat for a rope used by the navy. The rope extends linearly with respect to the cam, and the cleat can be secured in the blocked or the released position. The rope is not wound around the cam and can therefore not drive it as in a belaying and descending device for mountaineering.

OBJECT OF THE INVENTION

The object of the invention consists in providing a versatile belaying device enabling quick and precise unlocking of the cam, regardless of the diameter and the degree of friction of the rope on the cam.

The device according to the invention is characterized in that the cam is associated with a triggering ratchet able to occupy either a locked position performing blocking of the cam in the separated position or an unlocked position following a deliberate control action releasing said cam.

The cam remains immobilized in rotation and locked in the separated position by the ratchet during normal progression of the leading climber. Should the leading climber fall, the triggering control order results in the cam being releasing and driven in rotation to the securing position by the tension of the rope. The control order is given by the belayer either via the free strand of the rope which makes the triggering ratchet change position or by any other control means.

According to a preferred embodiment, the pivoting triggering ratchet comprises a clipping part, at one of the ends thereof, designed to latch in a locking notch of the cam, and comprises a control vane, at the opposite end thereof, which vane operates in conjunction with a spring biasing said ratchet to the locked position. The locking notch is situated at the end or near to an oblong opening arranged in the cam, said opening in the shape of a circular sector being centered on the axis of rotation of the cam and having a length at least equal to the angular movement of the cam between the separated and securing positions.

The triggering ratchet is advantageously associated with a selector which can be set either to a first setting position corresponding to a belaying function of the leading climber or to a second setting position corresponding to a belaying function of the second climber. In the first setting position, the selector enables the triggering ratchet to swivel between the locking and unlocked positions. In the second setting position of the selector, the triggering ratchet is immobilized in the unlocked position to release the cam.

According to another feature of the invention, the cam is coupled to an operating handle by means of a disengageable mechanical connection which is either active up to an intermediate position of the handle driving the cam to the separated position or inactive after said intermediate position has been passed causing the cam to be released and to return to the securing position.

BRIEF DESCRIPTION OF THE DRAWINGS

Other advantages and features will become more clearly apparent from the following description of two embodiments of the invention given as non-restrictive examples only and represented in the accompanying drawings in which.

DETAILED DESCRIPTION OF TWO EMBODIMENTS OF THE INVENTION

Figure 8:
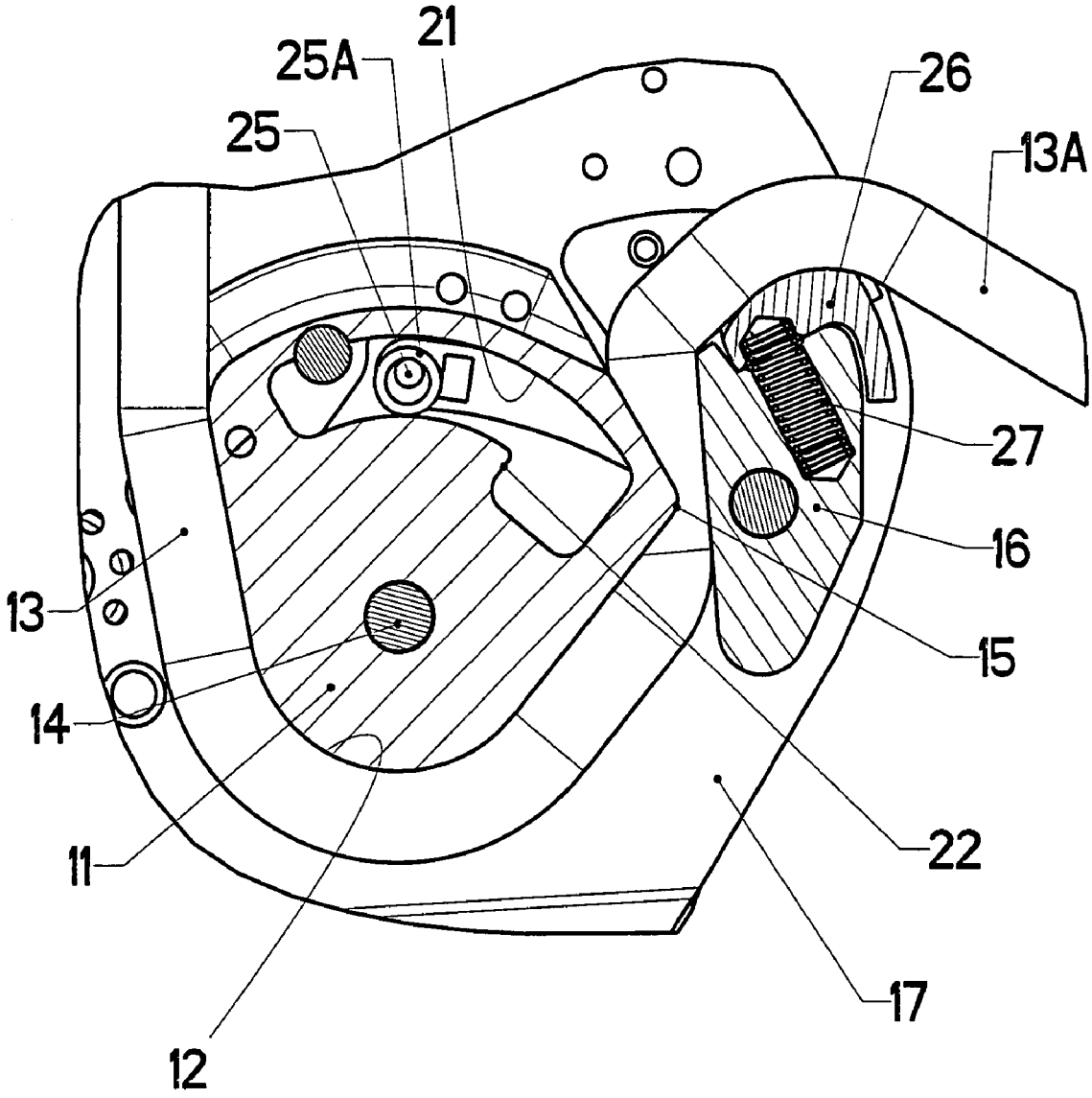
FIG. 8 is an identical view to FIG. 7 after the cam has rotated to the securing position blocking the rope against the fixed stud.

In FIGS. 1 to 13, a belaying device 10 for a rope comprises a blocking cam 11 having a peripheral sector provided with a groove 12 around which a rope 13 is wound in a half-turn. The cam 11 is mounted with limited rotation around a first fixed spindle-pin 14 and is able to move between a securing position corresponding to a blocking effect of the rope (FIG. 8) and a separated position corresponding to a releasing effect of the rope (FIG. 5).

In the securing position following a fall by the climber, the cam 11 is provided with a boss 15 designed to jam the rope 13 against a fixed stud 16. The stud 16 and spindle-pin 14 are secured by fixing means to the inside wall of a support plate 17 and are immobilized in rotation.

A retractable flange-plate 18 is mounted swiveling on a second spindle-pin 19 of the support plate 17 to occupy either an open position during the prior installation phase of the rope 13 around the cam 11 or a closed position (FIG. 2) to hold the rope 13 captive in the transverse gap 20 arranged between the support plate 17 and the flange-plate 18.

The cam 11 further comprises an oblong opening 21 of circular shape centered on the first spindle-pin 14 and presenting an internal locking notch 22 at the right end near to the boss 15.

A triggering ratchet 23 is arranged between the cam 11 and support plate 17 so as to control the movement of the cam 11. The triggering ratchet 23 is mounted swiveling around a third spindle-pin 24 so as to be either in a locked position or in an unlocked position. The third spindle-pin 24 is supported by the support plate 17 and is situated near to the stud 16 in the zone where the rope passes. One of the ends of the triggering ratchet 23 is equipped with a detent member 25 able to move in the oblong opening 21 of the cam 11, whereas the opposite end thereof is equipped with a control vane 26 operating in conjunction with a compression spring 27 housed in a blind hole of the stud 16. The detent member 25 is preferably equipped with a roller 25*a* to facilitate movement in the opening 21 after unlocking.

It is clear that the compression spring 27 can be replaced by any other type of return spring, for example a torsion spring inserted on the third spindle-pin 24.

Figure 9:
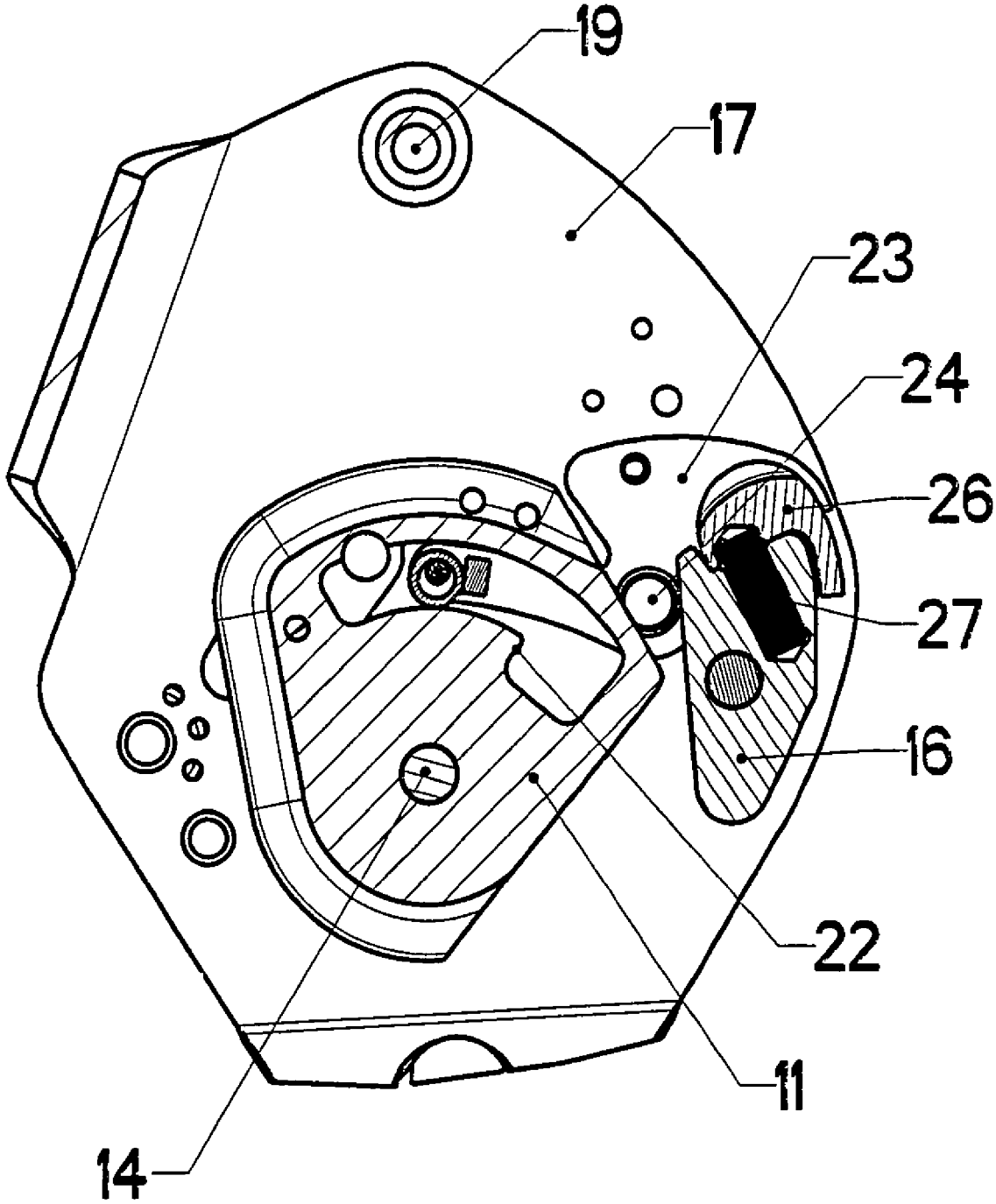
FIGS. 9 and 10 are identical views to FIGS. 8 and 4 after the selector has been set to the second setting position 2 corresponding to a belaying function of the second climber, or a descender function, the triggering ratchet being permanently blocked in the unlocked position to release the cam acting as a jammer.
Figure 10:
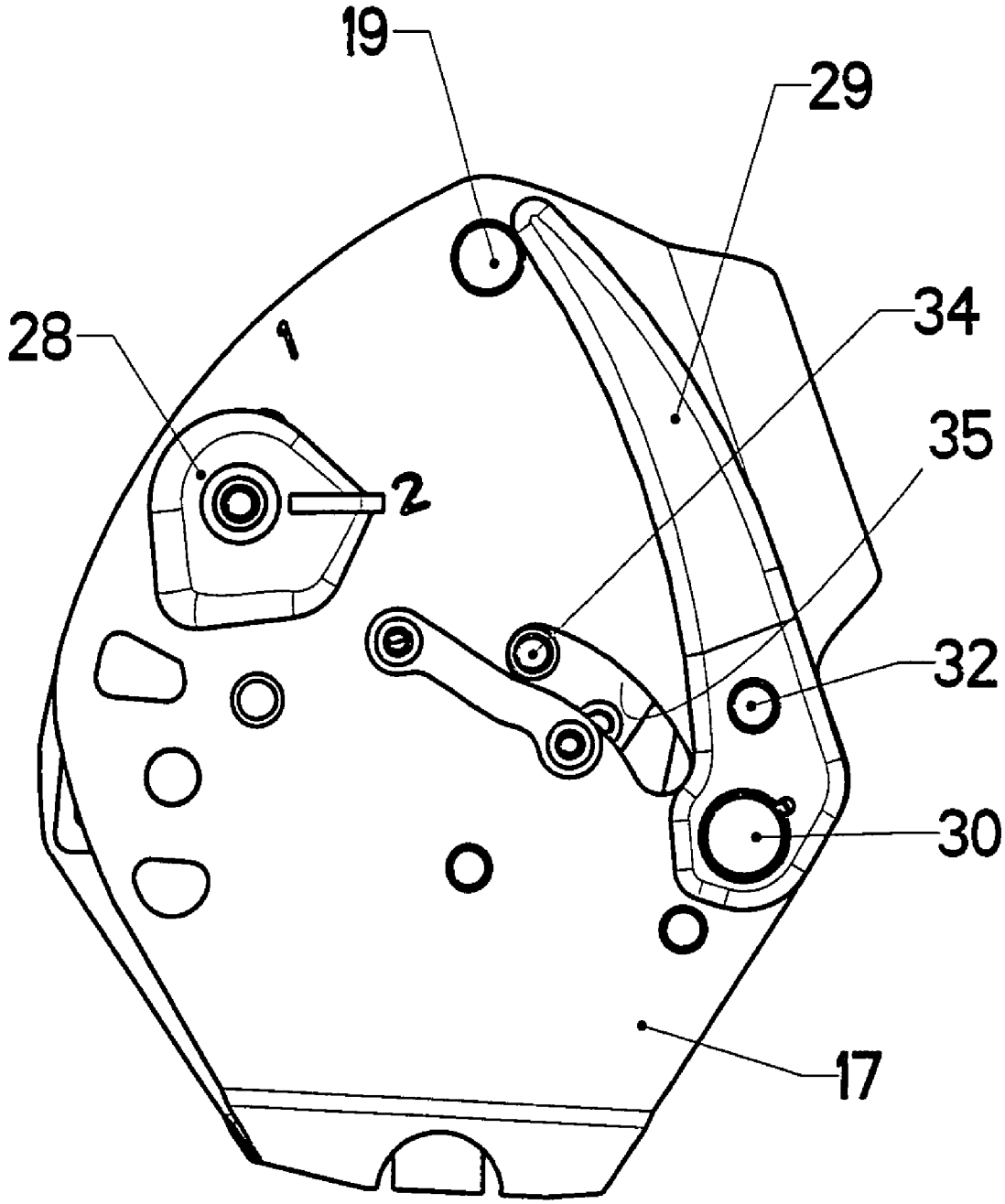
Figure 11:
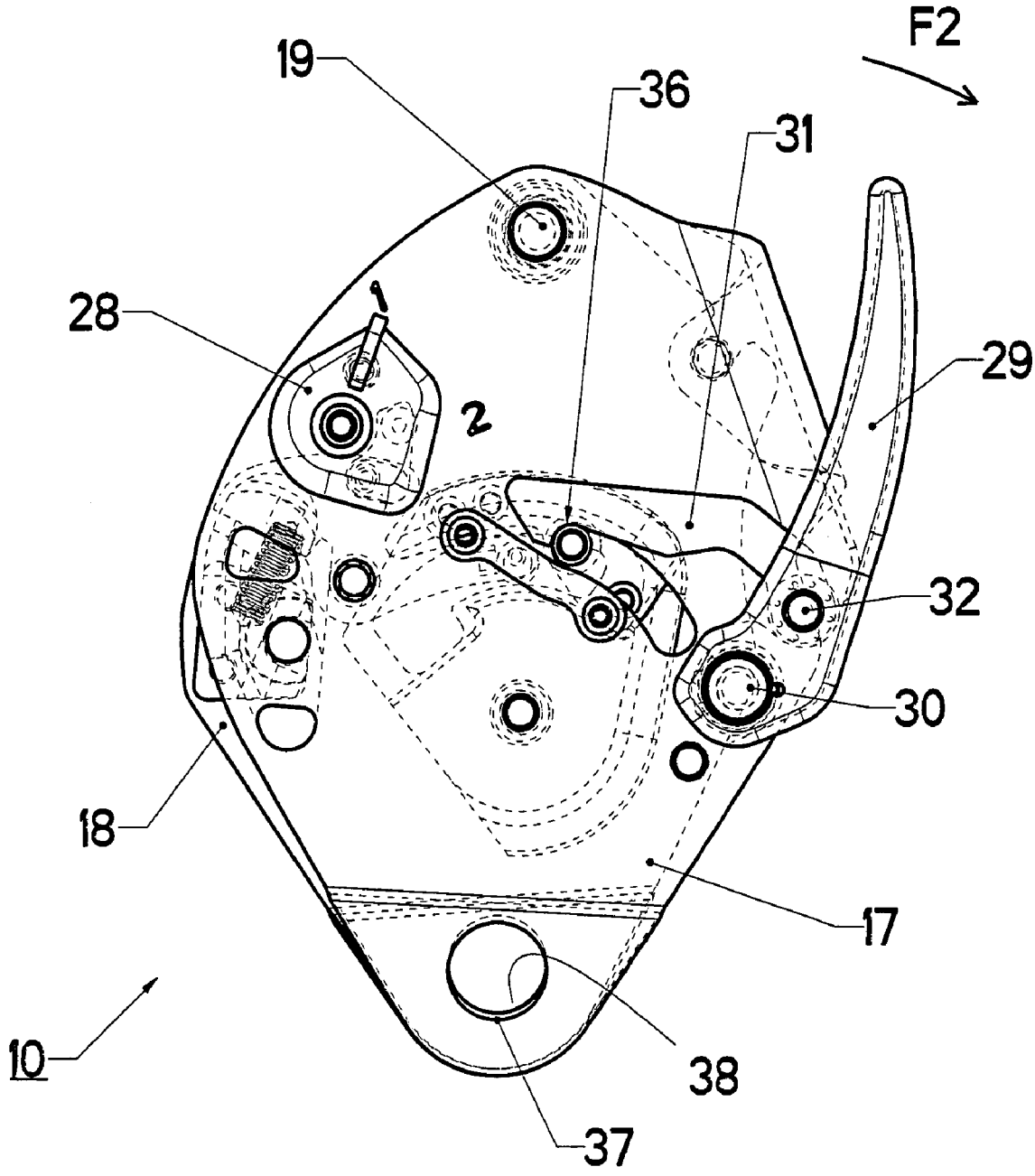
FIGS. 11, 12, 13 represent different phases of actuation of the operating handle respectively at the beginning of releasing of the cam, at the end of the releasing travel, and when anti-panic triggering takes place interrupting the disengageable mechanical connection to allow the cam to return to the securing position.

A selector 28, for example in the form of a rotary knob, is fitted on the outside face of the support plate 17 and is coupled to the triggering ratchet 23 to make the latter pivot manually either to a first setting position 1 (FIGS. 1 to 8) or to a second setting position 2 (FIGS. 9 to 11).

The first setting position 1 corresponds to operation belaying the leading climber, allowing two-way pivoting of the triggering ratchet 23 between the locking and unlocked positions. The triggering ratchet 23 can move automatically to the unlocked position (FIG. 7) when the slack first strand 13*a* of the rope 13 is in contact with and pressing on the vane 26 against the opposing force of the spring 27. The cam 11 is then released and can be driven in rotation to the securing position by the friction of the rope 13 in the groove 12.

The second setting position 2 of the device corresponds to operation belaying the second climber, or top-rope operation. In this position, the selector 28 immobilizes the triggering ratchet 23 in the unlocked position. The device then behaves as a jammer.

The belaying device 10 further comprises an operating handle 29 mounted with limited rotation around a fourth spindle-pin 30 borne by the outside face of the support plate 17, on the same side as the selector 28. A transmission rod 31 is articulated on the handle 29 to form a toggle device having an articulation spindle-pin 32 and operating in conjunction with cam 11 by means of a disengageable mechanical connection 36. The end of the rod 31 opposite the articulation spindle-pin 32, is shaped as a latching hook 33 able to engage with a drive spindle-pin 34 of the cam 11 when the mechanical connection 36 is active. The drive spindle-pin 34 passes for this purpose through a slot 35 arranged in the support plate 17 and having a length corresponding to the angular movement of the cam 11.

Figure 1:
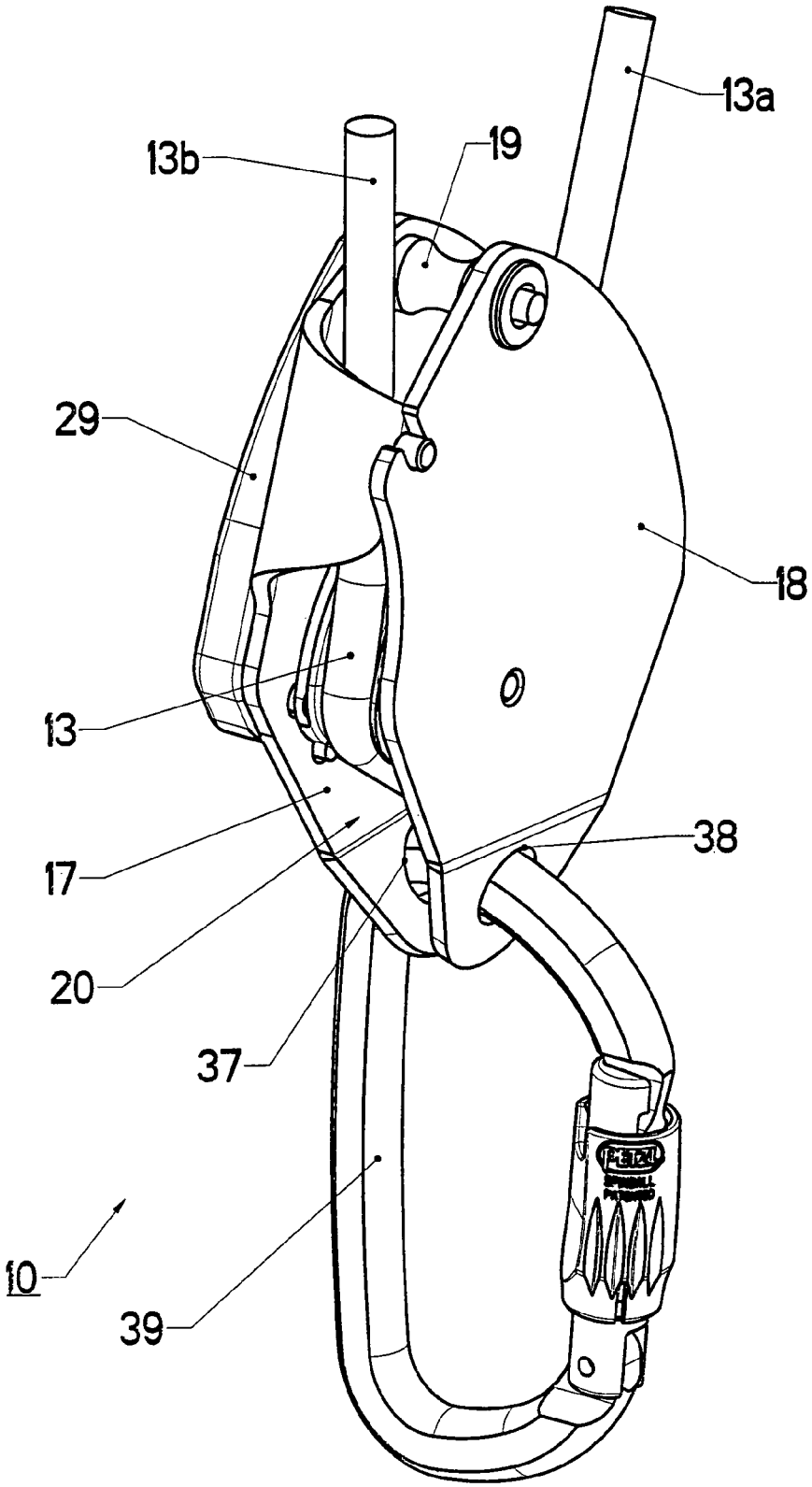
FIGS. 1 and 2 illustrate front and rear perspective views of the belaying device according to the invention after the swiveling flange-plate has been closed and the rope and attachment carabiner have been fitted in place.
Figure 2:
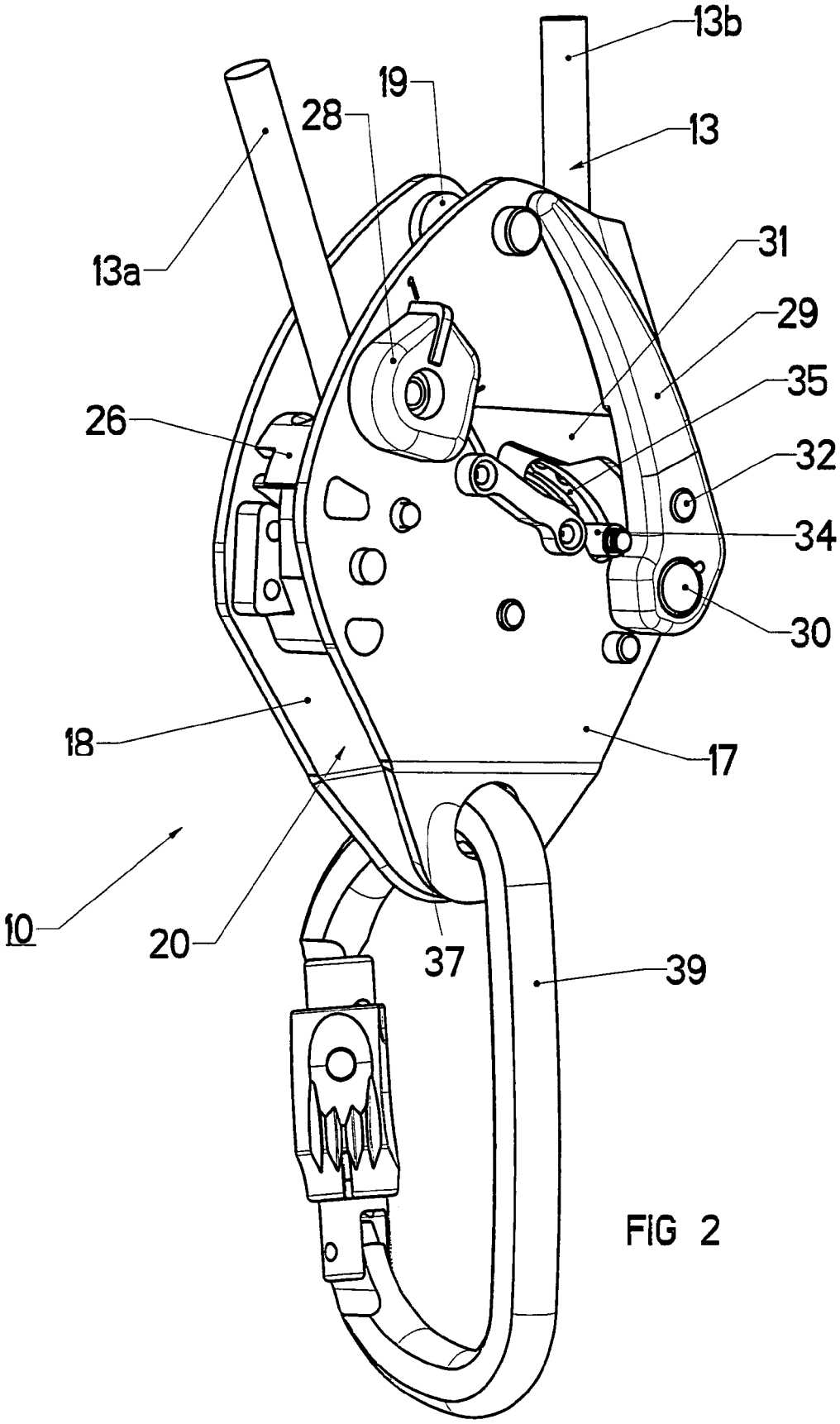

The support plate 17 comprises a first hole 37 at the base thereof, situated facing a second hole 38 of the flange-plate 18 when the latter occupies the closed position (FIG. 2). An attachment carabiner 39 can then be hooked into the two aligned holes 37, 38 to connect the device 10 to the belayer's harness. Movement of the flange-plate 18 to the open position is then impossible.

Operation of the belaying device 10 according to FIGS. 1 to 13 is as follows:

The rope 13 is first placed in the device 10 after the flange-plate 18 has been swiveled to the open position. The rope 13 simply has to be wound in the peripheral groove 12 of the cam 11 so as to form a U-shaped loop arranged around the cam 11 and passing through the blocking zone opposite the fixed stud 16. The flange-plate 18 is then swiveled back to the closed position, and the carabiner 39 is fitted in the holes 37, 38 and then hooked onto the harness.

The belaying device 10 according to the invention is versatile and can have different functions:

1) Belaying the Leading Climber (FIGS. 2 to 8)

Figure 3:
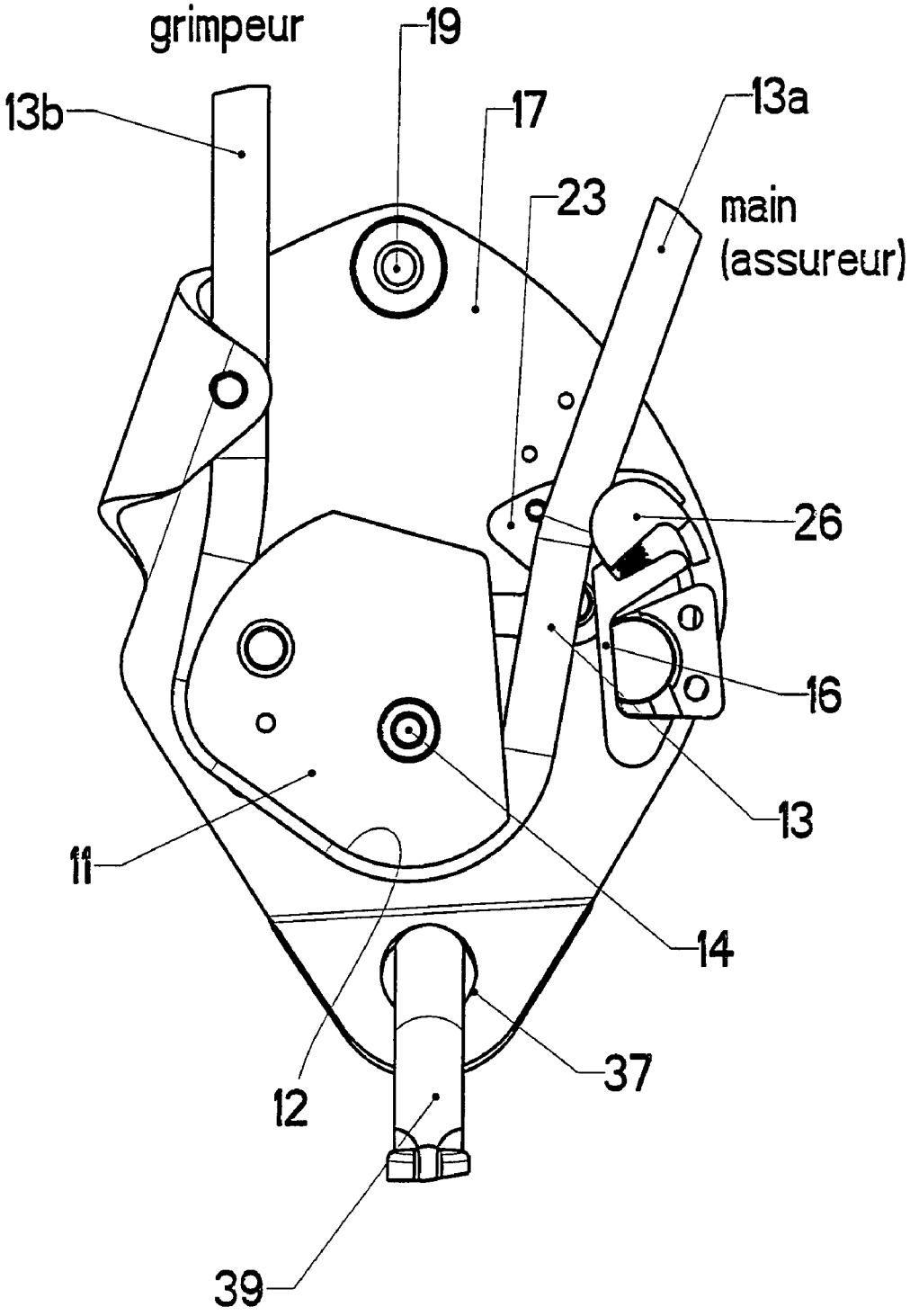
FIG. 3 represents an elevational view of the internal face of the support plate supporting the cam, the triggering ratchet, and the fixed stud, the cam being positioned in the separated position.
Figure 4:
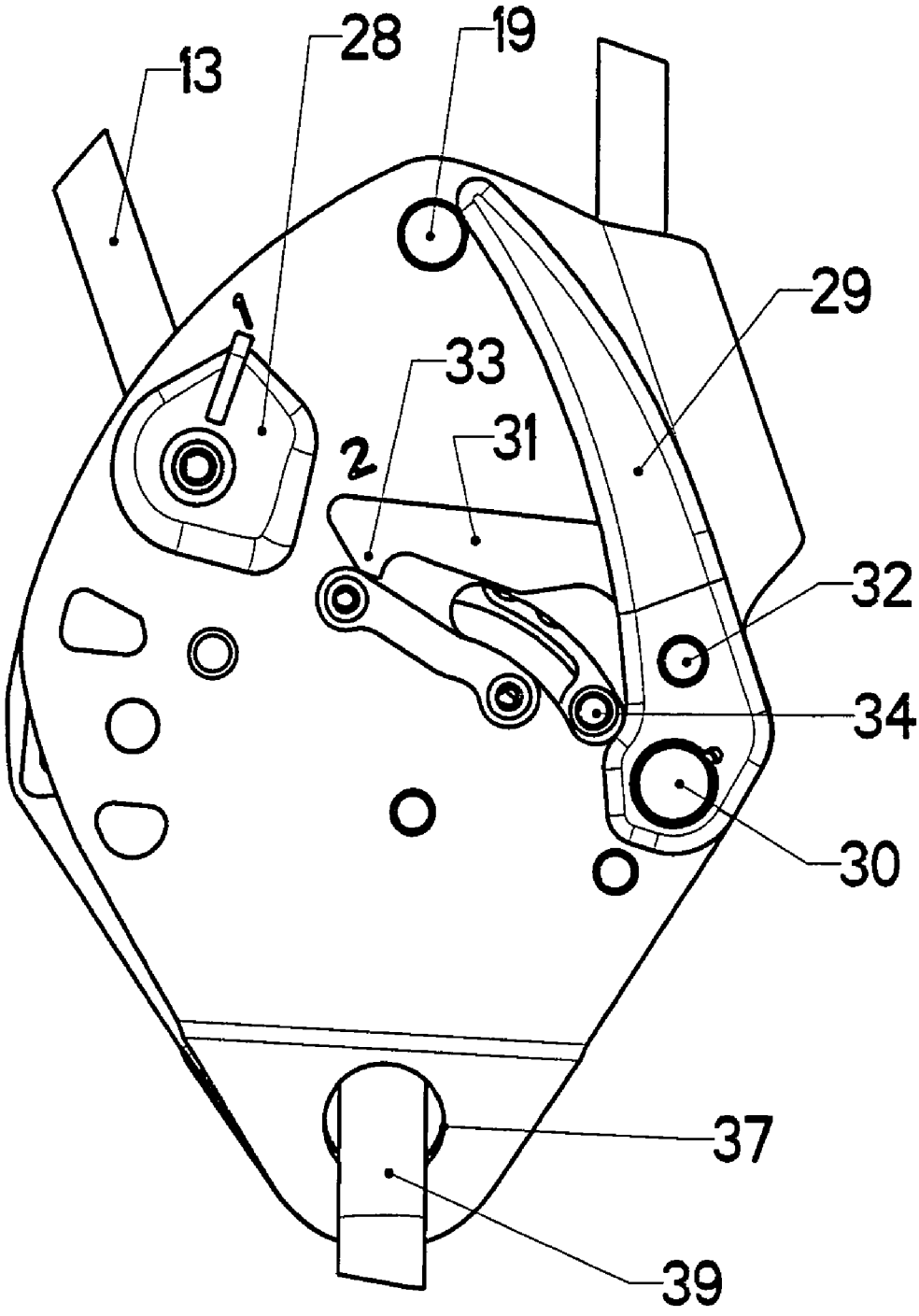
FIG. 4 shows an elevational view of the external face of the support plate equipped with the selector and with the operating handle, the selector being positioned in the first setting position 1 corresponding to a belaying function of the leading climber and the operating handle being stowed in an inactive position interrupting the mechanical connection with the cam.
Figure 5:
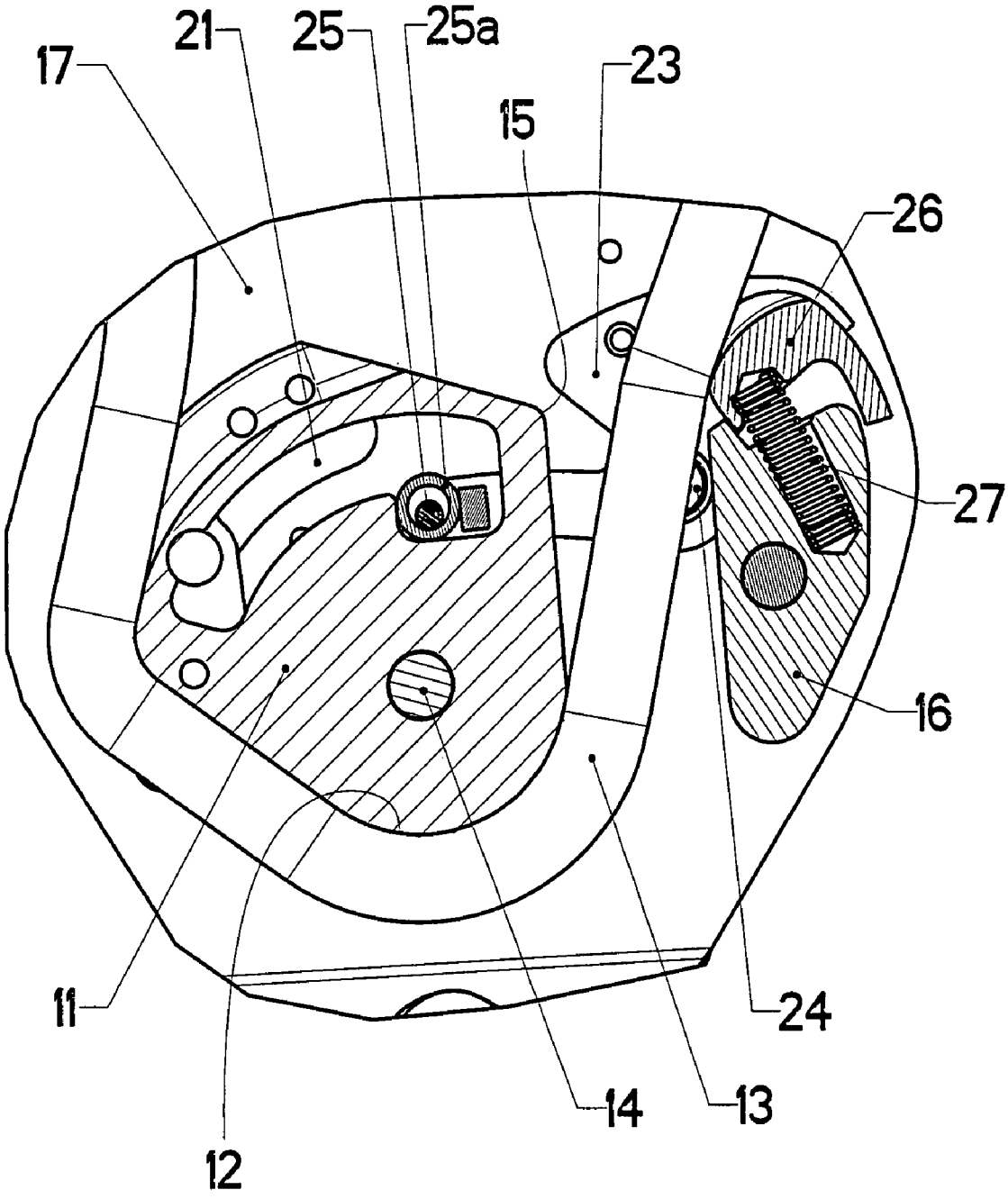
FIG. 5 is a partial cross-sectional view of FIG. 3 illustrating the cam locked in the separated position by the triggering ratchet to let the rope run freely.
Figure 6:
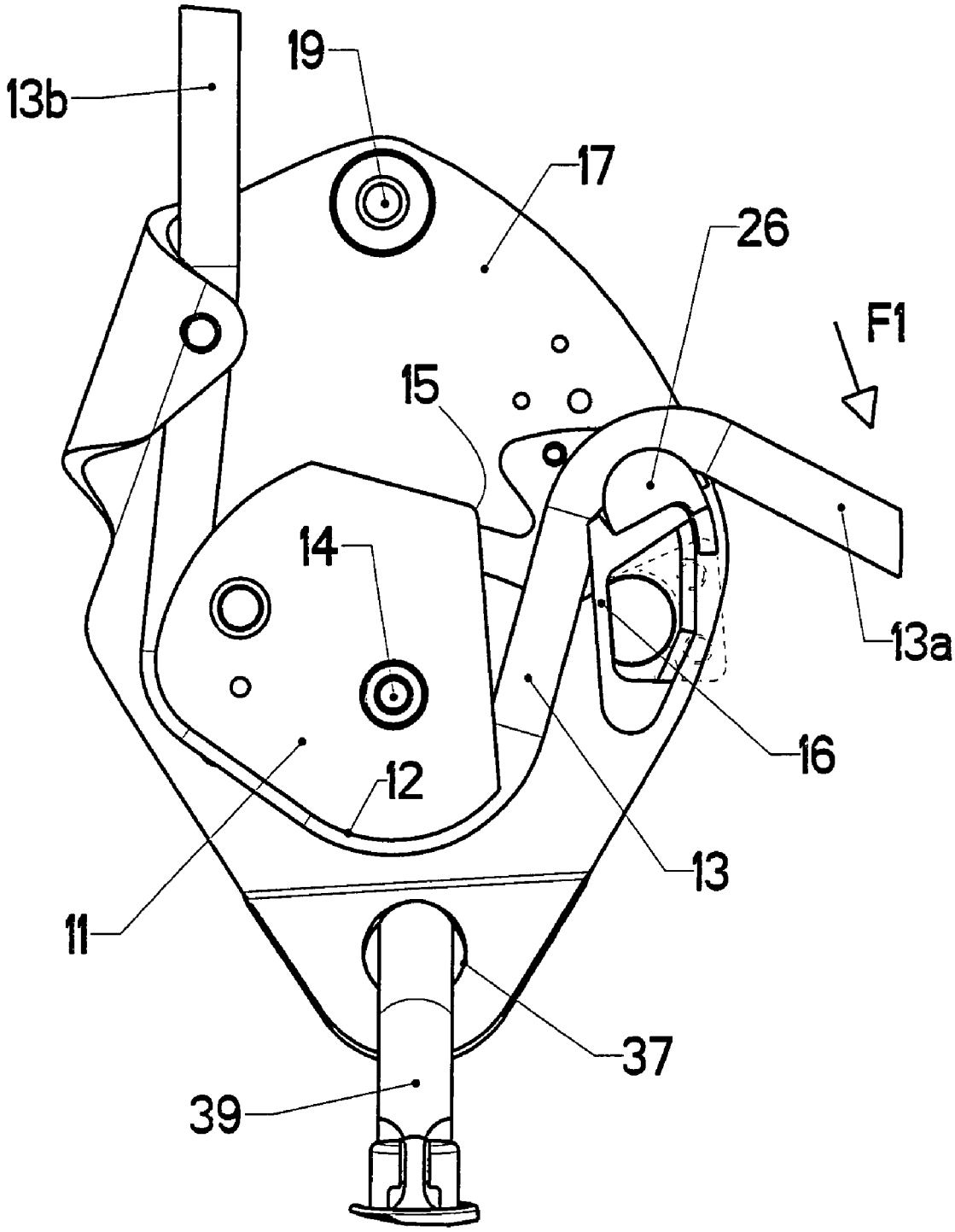
FIG. 6 represents an identical view to FIG. 3 when the downline rope strand is pressing on the triggering ratchet vane.
Figure 7:
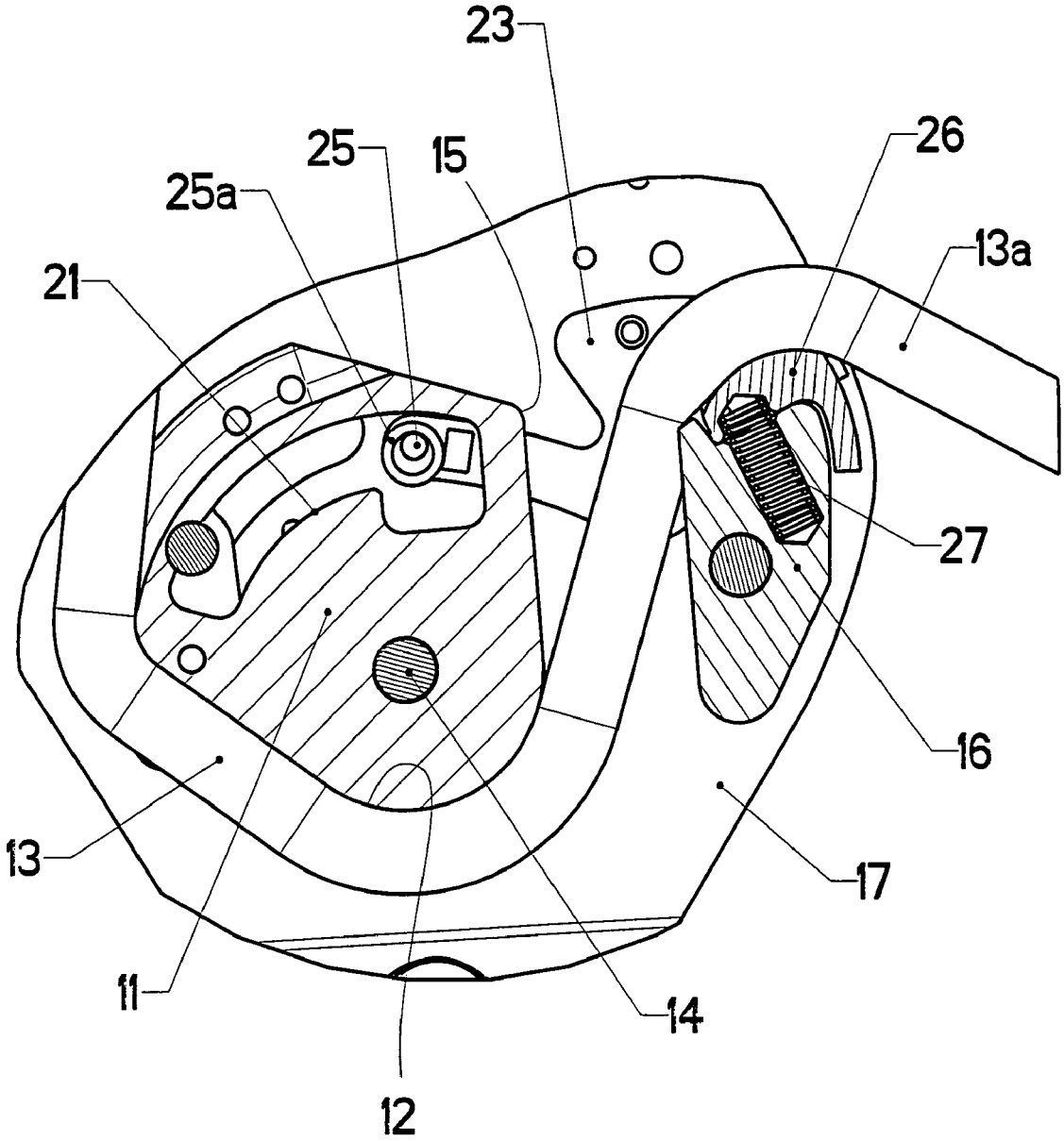
FIG. 7 is a partial cross-sectional view of FIG. 6 showing unlocking of the cam by removal of the ratchet.

The selector 28 is set to the first setting position 1 and the operating handle 29 is stowed in an inactive position that interrupts the mechanical connection 36 of the rod 31 with the cam 11 (FIGS. 2 to 4).

The free downline first strand 13*a* of the rope 13 passes over the vane 26 of the triggering ratchet 23, and the belayer, who is the leading climber, holds it in his hand. The upline second strand 13*b* is attached to the leading climber's harness. In the first setting position 1, the selector 28 enables the triggering ratchet 23 to swivel between the locking and unlocked positions.

When the leading climber is progressing normally, the cam 11 is immobilized in rotation and locked in the separated position by the ratchet 23 (FIG. 5). The rope 13 does not press on the vane 26 and the spring 27 biases the detent member 25 of the ratchet urging it into the locking notch 22 of the cam 11. The rope 13 can slide freely in the groove 12 of the cam 11 and in the passage gap between the cam 11 and the stud 16.

To stop a fall made by the leading climber, the belayer pulls the slack first strand 13*a* downwards (arrow F1, FIG. 6) thus making the triggering ratchet 23 pivot to the unlocked position (FIG. 7) against the opposing force of the spring 27. The cam 11 is released and is driven in rotation by the tension of the rope 13 to the securing position (FIG. 8), in which the boss 15 jams the rope against the stud 16. During this movement of the cam 11, the detent member 25 with its roller 25*a* moves towards the left end of the opening 21. This results in automatic stopping which stops the running of the rope 13 and ensures the safety of the leading climber.

It is clear that movement of the triggering ratchet 23 to the unlocked position can be achieved by any other operating means operated by the belayer.

Resetting the cam 11 in the separated position of FIG. 5 is achieved by retracting the rope 13 a few centimeters so as to drive the cam 11 counterclockwise by friction. At the end of travel, the spring 27 automatically replaces the detent member 25 in the locking notch 22 to lock the cam 11 in the separated position allowing the rope 13 to run freely.

2) Belaying the Second Climber (FIGS. 9 and 10)

The selector 28 is set to the second setting position 2 corresponding to operation either as second climber belayer or as top-rope. In this position, the selector 28 blocks the triggering ratchet 23 in the unlocked position so as to release the cam 11 permanently. The detent member 25 comes out of the locking notch 22 in the opening 21. The device thus acts as a simple rope jammer which blocks the downline strand 13*a* in the event of the climber downline from the belayer (second climber) falling. Belaying of the leading climber is in this case impossible.

Figure 12:
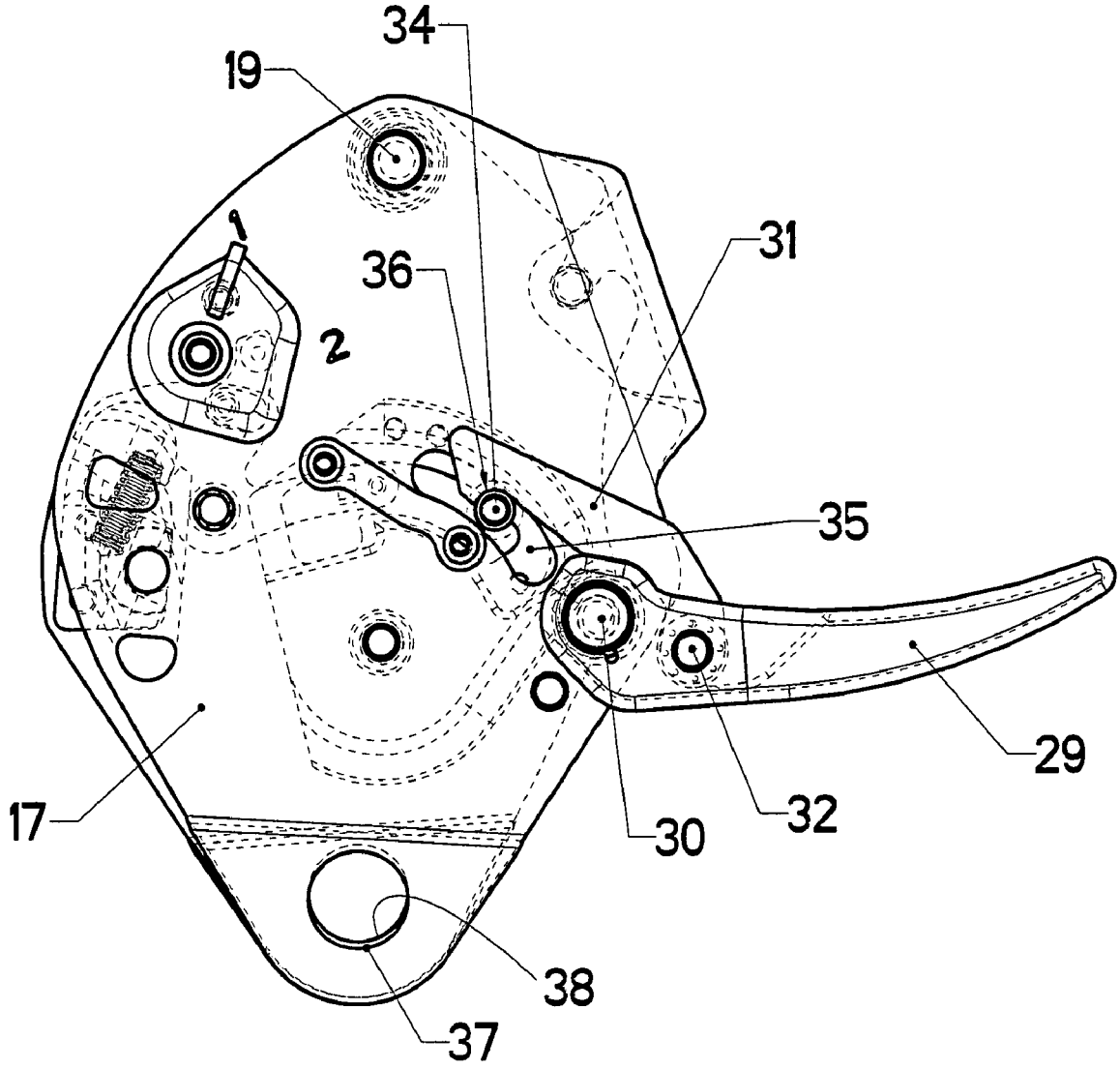
Figure 13:
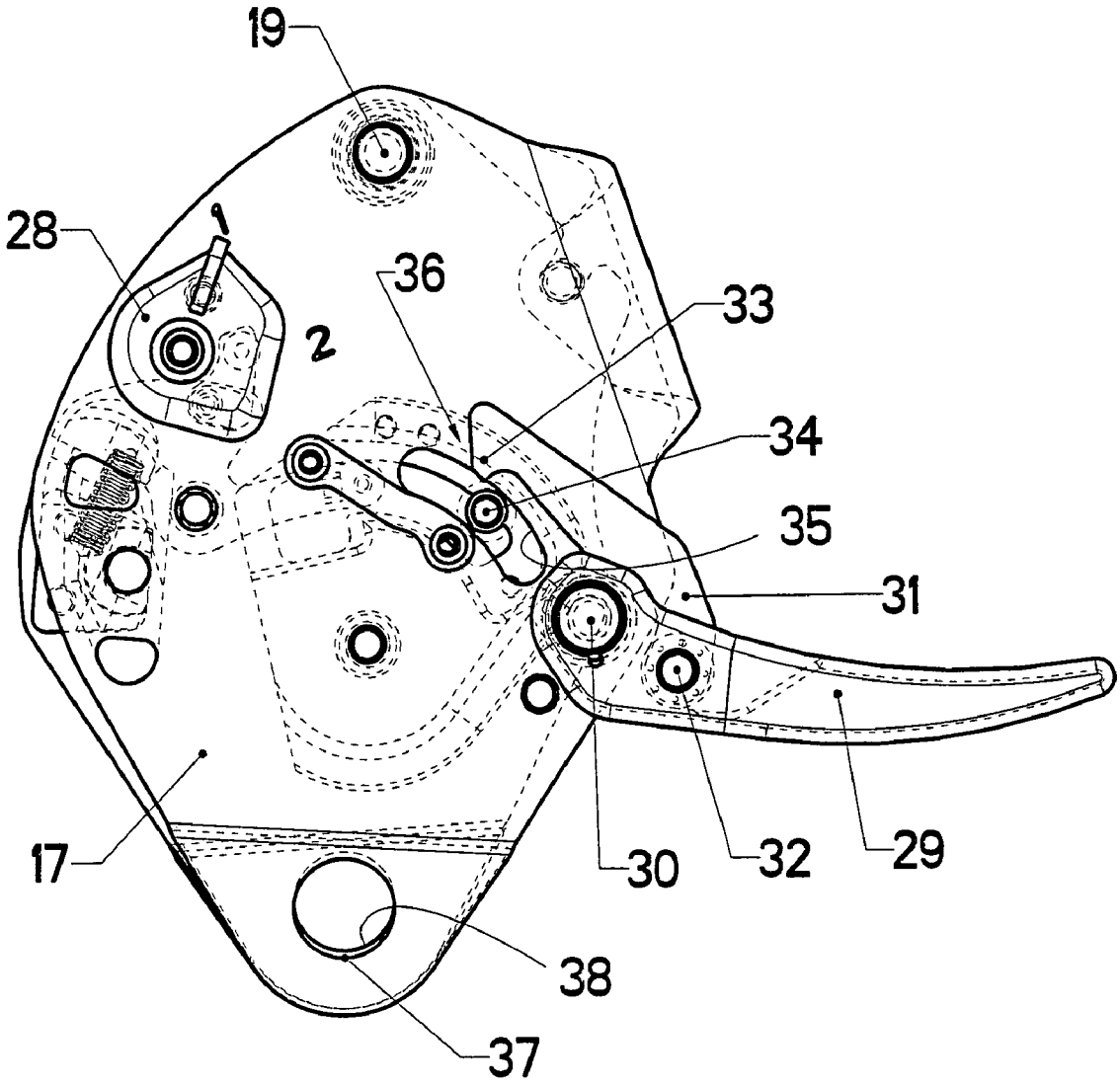

3) Releasing the Cam by Actuating the Operating Handle (FIGS. 11 to 13)

With the selector 28 in the first setting position 1, the operating handle 29 can be actuated clockwise (arrow F2, FIG. 11) to deliberately move the cam 11 to the separated position corresponding to releasing of the rope 13. At the beginning of travel of the handle 29 corresponding to an angular movement of about 15° to 20°, the latching hook 33 of the rod 31 is engaged with the drive spindle-pin 34 establishing the mechanical connection 36. Actuation of the handle 29 thus makes the cam 11 rotate in the releasing direction of the rope 13.

In FIG. 12, the handle 29 performs a movement with a travel of about 90°, corresponding to releasing of the cam 11. The rod 31 presses on the handle 29 and its trajectory is then centered on the fourth spindle-pin 30 whereas the mechanical connection 36 is still active.

FIG. 13 corresponds to anti-panic triggering after movement of the operating handle 29 has been continued beyond the previous position of FIG. 12, notably to about 96°. The rod 31 moves with the handle 29 so as to interrupt the mechanical connection 36 by the latching hook 33 coming away from the spindle-pin 34. The cam 11 becomes free again and comes and blocks the rope against the stud 16.

Figure 14:
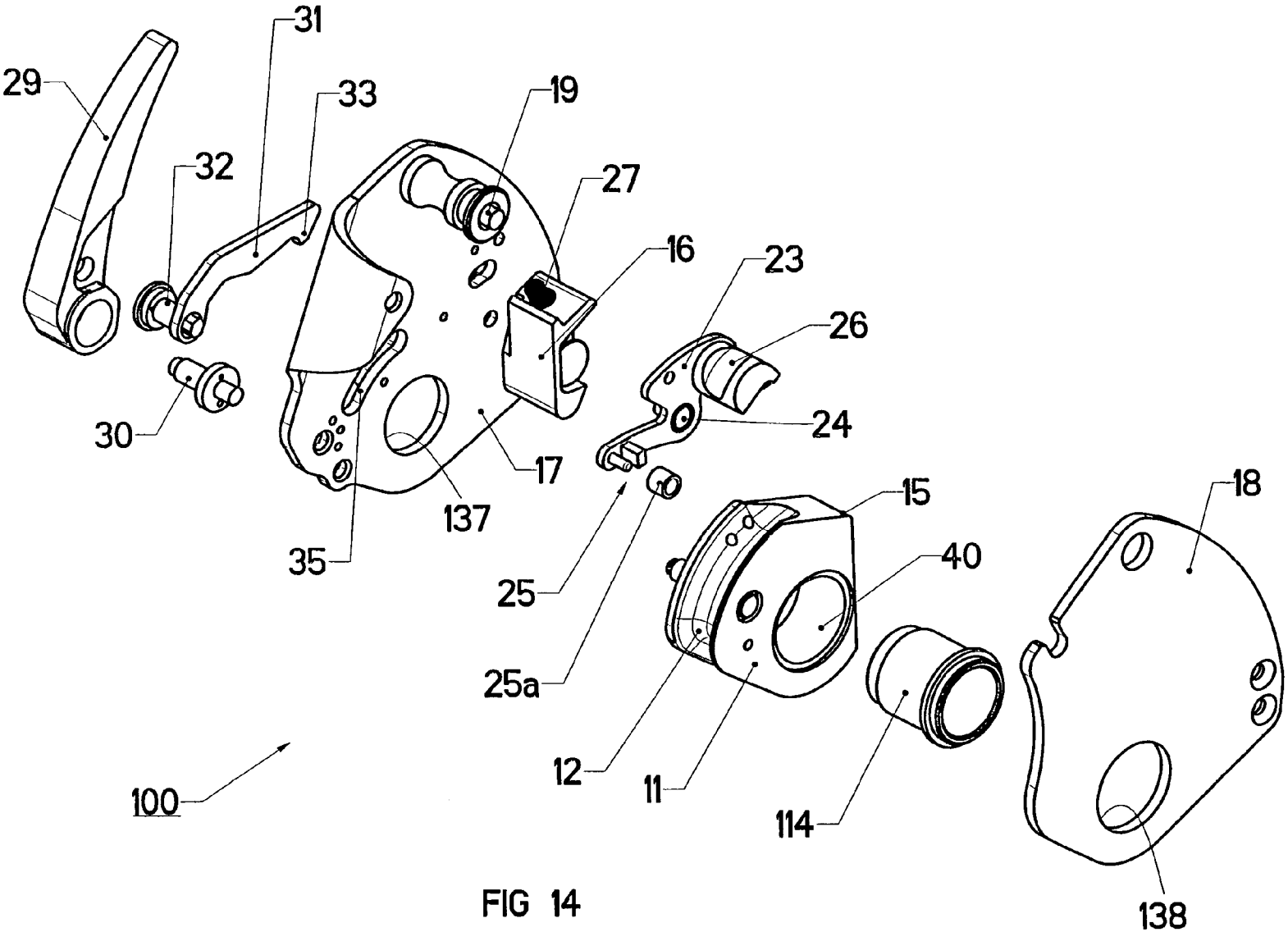
FIG. 14 is an exploded perspective view of an alternative embodiment of the belaying device.
Figure 15:
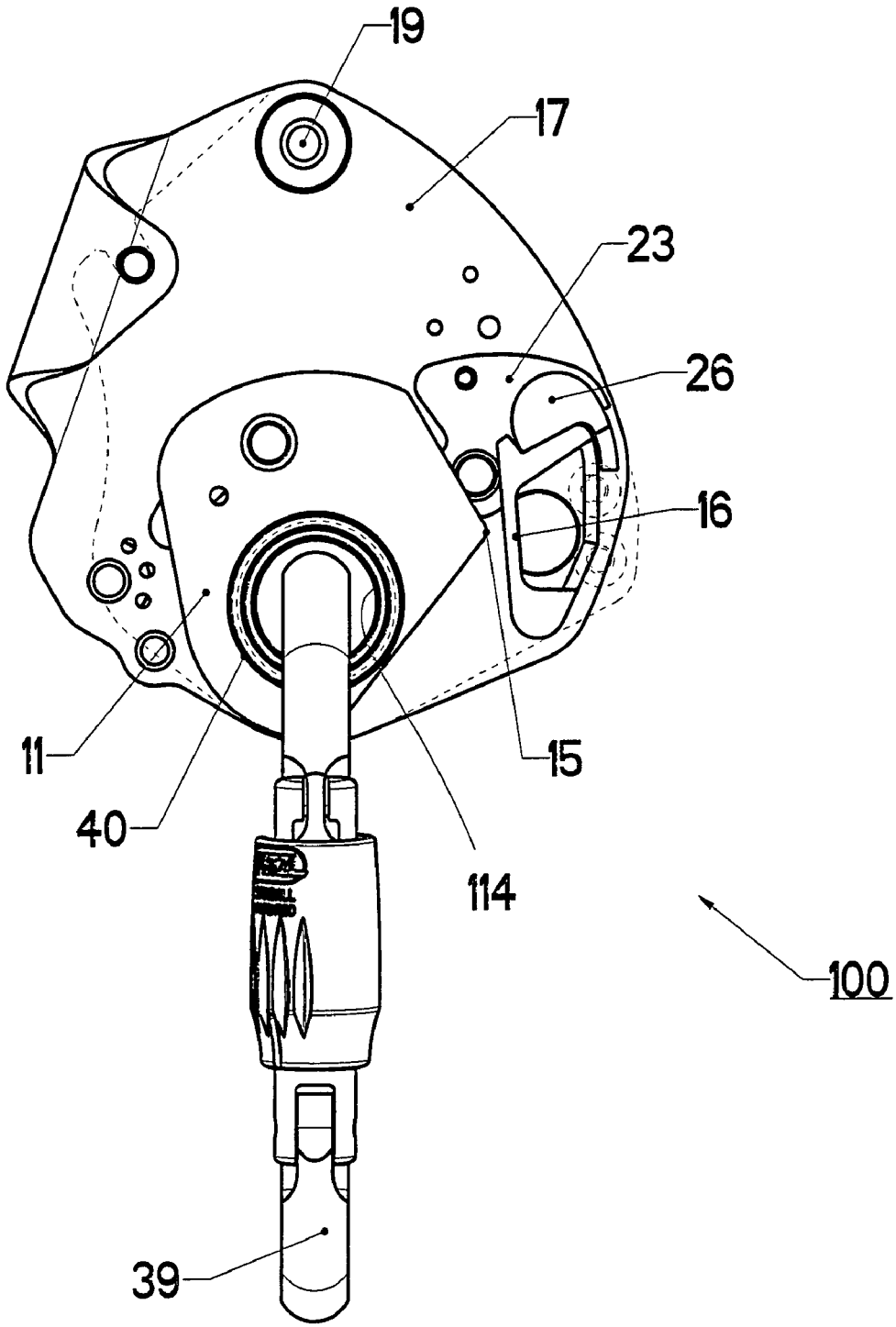
FIG. 15 shows an elevational view of the assembled device after the front flange-plate has been removed.

In the alternative embodiment of the belaying device 100 illustrated in FIGS. 14 and 15, the same reference numbers will be used to designate identical or similar parts to those of the previous FIGS. 1 to 13. The first spindle-pin 114 is hollow, being formed by a tubular sleeve extending perpendicularly to the support plate 17. The cam 11 is provided with an axial bore 40 of circular cross-section with a slightly larger diameter than that of the sleeve which acts as a journal bearing when the rotary cam 11 is fitted. The holes 137, 138 arranged in the support plate 17 and the flange-plate 18 of the device 100 are aligned with the sleeve of the hollow spindle-pin 114 for passage of the attachment carabiner 39.

The other parts of the device 100 are identical to those used in the device 10 of FIGS. 1 to 13.

The belaying device 100 presents a compact overall size due to the reduction of the heightwise dimensions of the support plate 17 and of the flange-plate 18. Inserting the attachment carabiner 39 in the hollow spindle-pin 114 of the cam 11 positions the device 100 very close to the user enabling him to give slack more quickly.

The invention claimed is:

1. A belaying device for a rope, comprising:

a support plate equipped with a fixed stud, a gap situated between the stud and a cam, the cam being mounted with limited rotation on the support plate about a first spindle-pin and having a peripheral sector around which the rope is wound, said cam having a securing position and a separated position wherein the cam is movable between the securing position, in which the rope is securely held against the stud, and the separated position, which enables the rope to run freely in the gap between the cam and the stud, and a triggering ratchet having a locked position and an unlocked position, the triggering ratchet movable between the locked position, in which the triggering ratchet is positioned to lock the cam in the separated position, and the unlocked position; the triggering ratchet being moved to the unlocked position after a response to a control action releasing said cam from the separated position, wherein the triggering ratchet is mounted with limited capability of pivoting on a third spindle-pin and comprises a detent member, the cam comprises a locking notch, and the detent member engages with the locking notch, the triggering ratchet is equipped with a control vane operating in conjunction with a spring, the spring biasing the triggering ratchet to the locked position, and an action of a first strand of the rope pressing on the control vane is capable of moving the triggering ratchet to the unlocked position, and the locking notch being formed in an oblong opening arranged in the cam, said opening including a shape of an arc being a radial distance from the first spindle-pin and having a length that is at least equal to a distance moved after an angular movement of the cam moving between the separated position and securing position.

2. The belaying device according to claim 1, wherein the cam is released as a result of a down-line first strand of the rope pressing on the triggering ratchet.

3. The belaying device according to claim 1, the control vane of the triggering ratchet being situated near to the fixed stud, and the spring being a compression spring housed in a blind hole of the fixed stud.

4. The belaying device according to claim 1, wherein the detent member of the triggering ratchet operates in conjunction with a roller arranged in the oblong opening of the cam or in the locking notch.

5. The belaying device according to claim 1, wherein the triggering ratchet is associated with a selector, the selector capable of being set to a first setting position, corresponding to an operation for a leading climber belayer, or to a second setting position, corresponding to an operation for a second climber belayer.

6. The belaying device according to claim 5, wherein the triggering ratchet is inserted between the cam and an inside wall of the support plate, and the selector is fitted on an external face of the support plate.

7. The belaying device according to claim 5, wherein in the second setting position of the selector, the triggering ratchet is immobilized in the unlocked position to release the cam.

8. The belaying device according to claim 1, wherein the cam is coupled to an operating handle by a disengageable mechanical connection, the disengageable mechanical connection is capable of being coupled to the cam in an intermediate position, in which the handle is positioned to drive the cam to the separated position, the disengageable mechanical connection being further capable of being disengaged from the cam after the handle has been moved to another position, past said intermediate position, which causes the cam to be released and to return to the securing position.

9. The belaying device according to claim 8, wherein the operating handle is articulated on a transmission rod wherein the operating handle is articulated on a transmission rod to form a toggle device connected to a drive spindle-pin of the cam by the mechanical connection.

10. The belaying device according to claim 1, wherein the first spindle-pin of the cam is hollow for passage of an attachment karabiner.

11. The belaying device according to claim 1, wherein a flange-plate is mounted to swivel around a second spindle-pin of the support plate to occupy one of an open position, which is prior to a winding phase of the rope around the cam, and a closed position that holds the rope captive in a transverse gap arranged between the support plate and the flange-plate.

* * * * *